US008275163B2

(12) United States Patent
Fickweiler et al.

(10) Patent No.: US 8,275,163 B2
(45) Date of Patent: Sep. 25, 2012

(54) BATTERY COMPARTMENT WITH LATCHING ELEMENT FOR A BEHIND-THE-EAR HEARING DEVICE AND BEHIND-THE-EAR HEARING DEVICE

(75) Inventors: Werner Fickweiler, Bubenreuth (DE); Björn Freels, Nürnberg (DE); Markus Trautner, Nürnberg (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 326 days.

(21) Appl. No.: 12/683,462

(22) Filed: Jan. 7, 2010

(65) Prior Publication Data

US 2010/0172528 A1 Jul. 8, 2010

(30) Foreign Application Priority Data

Jan. 7, 2009 (DE) ..... 10 2009 004 006

(51) Int. Cl.
*H04R 25/00* (2006.01)

(52) U.S. Cl. ..... 381/323; 381/322; 381/330

(58) Field of Classification Search ..... 381/322–324, 381/327, 330, 381
See application file for complete search history.

(56) References Cited

U.S. PATENT DOCUMENTS

| | | | | |
|---|---|---|---|---|
| 3,475,566 | A * | 10/1969 | Bauer | 381/323 |
| 5,386,476 | A | 1/1995 | Bisgaard et al. | |
| 7,668,326 | B2 | 2/2010 | Linkenkaer-Hansen | |
| 2004/0062410 | A1 | 4/2004 | Wagner et al. | |
| 2008/0013765 | A1 | 1/2008 | Nielsen et al. | |
| 2008/0044049 | A1 | 2/2008 | Ho et al. | |
| 2009/0202092 | A1 | 8/2009 | Ruppert | |
| 2012/0014547 | A1 * | 1/2012 | Sjursen et al. | 381/323 |

FOREIGN PATENT DOCUMENTS

| | | | |
|---|---|---|---|
| DE | 102006029815 | A1 | 1/2008 |
| EP | 2091270 | A1 | 8/2009 |
| EP | 2144456 | A1 | 1/2010 |
| WO | 2004073351 | A1 | 8/2004 |
| WO | 2006081818 | A1 | 8/2006 |

OTHER PUBLICATIONS

Jens Ulrich and Eckhard Hoffmann, "Hörakustik Theorie Und Praxis," 1. Auflage, Oct. 2007, published Heidelberg, Germany, p. 1127, ISBN 978-3-922269-80-9.

* cited by examiner

*Primary Examiner* — Suhan Ni
(74) *Attorney, Agent, or Firm* — Laurence A. Greenberg; Werner H. Stemer; Ralph E. Locher

(57) ABSTRACT

A battery compartment for a behind-the-ear hearing device includes a battery compartment body having a battery receiving space for accommodating a battery and at least one latching element for locking to a hearing device housing. The latching element and the battery compartment body are formed of different materials and the latching element is disposed in a holding device in the battery compartment body. A behind-the-ear hearing device with a latching element and the use of polyoxymethylene for manufacturing the latching element, are likewise provided. As a result of the separation of the latching element and the battery compartment body and the use of different materials, a switching and locking function can be optimized and the wearing quality can be improved.

9 Claims, 2 Drawing Sheets

BATTERY COMPARTMENT WITH LATCHING ELEMENT FOR A BEHIND-THE-EAR HEARING DEVICE AND BEHIND-THE-EAR HEARING DEVICE

CROSS-REFERENCE TO RELATED APPLICATION

This application claims the priority, under 35 U.S.C. §119, of German Patent Application DE 10 2009 004 006.4, filed Jan. 7, 2009; the prior application is herewith incorporated by reference in its entirety.

BACKGROUND OF THE INVENTION

Field of the Invention

The invention relates to a battery compartment for a behind-the-ear hearing device, including a battery compartment body having a battery receiving space for accommodating a battery and at least one latching element for locking to a hearing device housing. The invention also relates to a behind-the-ear hearing device including a microphone and an earpiece. The invention additionally relates to a battery compartment and a behind-the-ear hearing device in which polyoxymethylene is used.

Hearing devices are portable hearing apparatuses which are used to supply the hard-of-hearing. In order to accommodate numerous individual requirements, different configurations of hearing devices, such as behind-the-ear hearing devices (BTE), hearing devices with an external earpiece and in-the-ear hearing devices (ITE), e.g. concha hearing devices or channel hearing devices (CIC), are provided. The hearing devices, by way of example, are worn on the outer ear or in the auditory canal. Furthermore, bone conduction hearing aids, implantable or vibrotactile hearing aids are also available on the market. The damaged ear is thereby either stimulated mechanically or electrically.

Important components of the hearing devices include, in principal, an input converter, an amplifier and an output converter. The input converter is generally a recording transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. Such a main configuration is shown in FIG. 1 as an example of a behind-the-ear hearing device. One or a number of microphones 2 for recording ambient sound are incorporated in a hearing device housing 1 to be worn behind the ear. A signal processing unit 3, which is similarly integrated into the hearing device housing 1, processes microphone signals and amplifies them. An output signal of the signal processing unit 3 is transmitted to a loudspeaker and/or earpiece 4, which outputs an acoustic signal. The sound is optionally transmitted to the ear drum of the device wearer through a sound tube, which is fixed with an otoplastic in the auditory canal. A power supply of the hearing device and in particular of the signal processing unit 3, is supplied by a battery 5 which is likewise integrated into the hearing device housing 1.

Batteries of a behind-the-ear hearing device or of an in-the-ear hearing device are generally held in the hearing device with the aid of a battery compartment, which is also referred to as a battery charger. The battery compartment is generally disposed so as to be able to swivel. In the swiveled-in state, the battery is in an operating position, while in a swiveled-out state of the battery compartment, it can be removed from the hearing device.

German Published, Non-Prosecuted Patent Application DE 10 2006 029 815 A1, corresponding to U.S. Patent Application Publication No. US 2008/0044049 A1, describes a swivelable battery compartment of that type of a behind-the-ear hearing device. A battery compartment body for receiving a battery includes a projection on its wall. The projection is used for a hinged coupling of the battery compartment body to a behind-the-ear hearing device. Furthermore, the wall includes a locking element, which is used to lock the battery compartment body to the behind-the-ear hearing device. The locking takes place in the manner of a latch. A latch of that type can also include an intermediate position in order to switch the hearing device off if the battery compartment is slightly open.

The battery compartment is frequently opened and closed since a hearing device wearer is recommended to open the compartment overnight so that moisture can escape from the hearing device. The frequent use of the locking element wears the latch out over time. If the switching function wears out, the battery compartment is changed by the service department. The latch must also be able to be finely tuned, which can only be realized with difficulty in the case of transparent plastics. Non-transparent battery compartments are thus generally used, although the hearing device housing is embodied in a transparent color. That disturbs many hearing device wearers.

SUMMARY OF THE INVENTION

It is accordingly an object of the invention to provide a battery compartment with a latching element for a behind-the-ear hearing device and a behind-the-ear hearing device, which overcome the hereinafore-mentioned disadvantages of the heretofore-known devices of this general type.

With the foregoing and other objects in view there is provided, in accordance with the invention, a battery compartment for a behind-the-ear hearing device. The battery compartment comprises a battery compartment body defining a battery receiving space for accommodating a battery, a holding device disposed in the battery compartment body, and at least one latching element disposed in the holding device for locking to a hearing device housing. The latching element and the battery compartment body are formed from different materials.

Separating the latching element from the remaining battery compartment allows the switching and latching function to be optimized and the wear quality to be improved. This can be achieved above all by a material being used which is suited to a latching function, while the battery compartment body can be manufactured from a material which fulfils other requirements such as, for instance, cosmetic appearance, mechanical stability or surface condition. For instance, transparent battery compartment bodies can now be used.

In accordance with another feature of the invention, the material of the latching element can be a plastic which is suited to multiple latches. The long service life of the latching element is advantageous in this case.

In accordance with a further feature of the invention, the latching element can be releasably fixedly held in an opening of the holding device through the use of a clamping fit. This is advantageous in that the latching element can be easily exchanged in a wear-dependent fashion.

In accordance with an added feature of the invention, the battery compartment body and the latching element can also be produced in one operation in a 2K injection molding method. A cost-effective manufacture is possible as a result.

In accordance with an additional feature of the invention, the holding device can be embodied as part of a wall of the battery compartment body. This is advantageous in that no additional working step is needed during manufacture.

In accordance with yet another feature of the invention, the battery compartment can include two latching elements with latching channels disposed in parallel to one another. A more uniform latch is advantageous in this case.

In accordance with yet a further feature of the invention, the color of the latching element can be used as a right-left identifier. This is advantageous in that no additional identification has to take place.

In accordance with yet an added feature of the invention, a battery holding spring can be provided in at least one latching element. This is advantageous in that no additional battery fixing is needed.

With the objects of the invention in view, there is also provided a behind-the-ear hearing device, comprising a microphone, an earpiece and a battery compartment according to the invention.

With the objects of the invention in view, there is concomitantly provided a battery compartment for a behind-the-ear hearing device and a behind-the-ear hearing device in which polyoxymethylene (POM) is used as a material for the latching element. POM, as a partially crystalline thermoplastic plastic, also provides great rigidity, low frictional coefficients and excellent dimensional stability.

Other features which are considered as characteristic for the invention are set forth in the appended claims.

Although the invention is illustrated and described herein as embodied in a battery compartment with a latching element for a behind-the-ear hearing device and a behind-the-ear hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
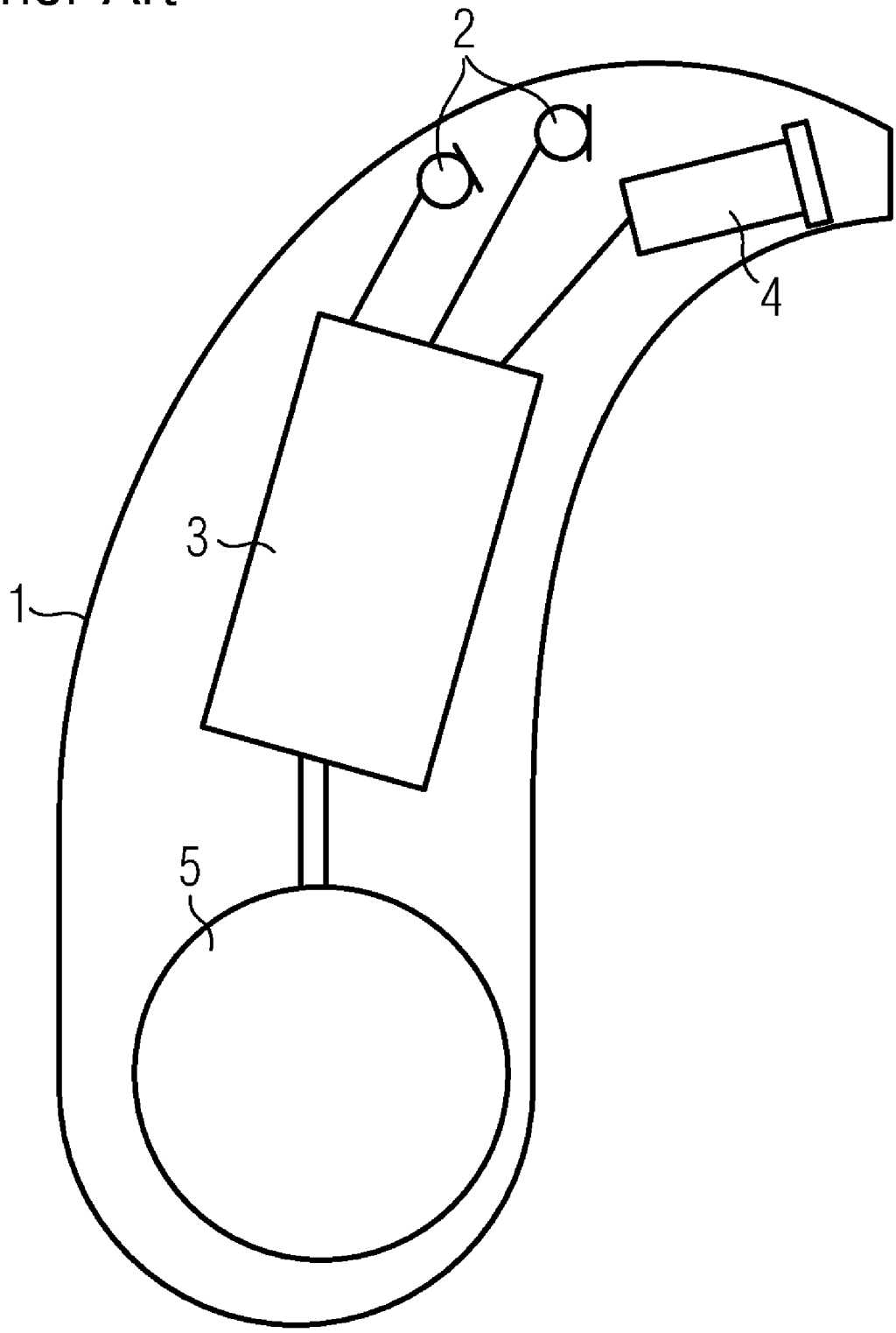
FIG. 1 Prior Art
FIG. 1 is a diagrammatic, side-elevational view of a behind-the-ear hearing device according to the prior art.
Figure 2:
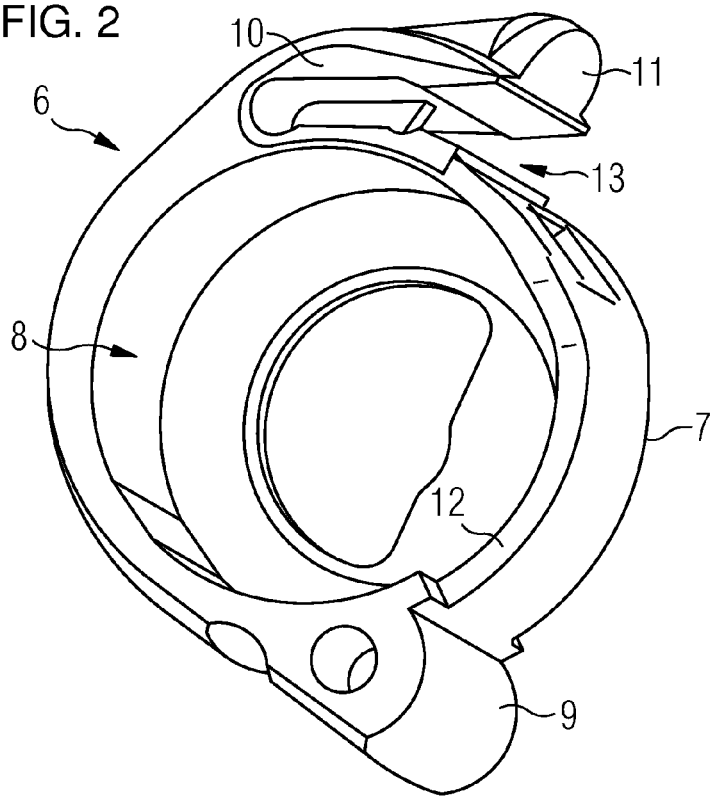
FIG. 2 is a perspective view of a battery compartment with a latching element according to the invention.

Referring now to the figures of the drawings in detail and first, particularly, to FIG. 2 thereof, there is seen a perspective view of a battery compartment 6 with a battery compartment body 7 which, together with its wall 12, forms a battery receiving space 8 for inserting a battery. In order to rotatably mount and fasten the battery compartment 6, the battery compartment body 7 has a swivel joint 9 in the form of a cylindrical projection with a borehole. A tongue-type holding module 11 is embodied opposite thereto in the battery compartment body 7 and has a slot-shaped opening in which a latching element 10 is disposed.

The latching element 10 and the battery compartment body 7 are manufactured from different plastics. Acrylnitril-Butadian-Styrol (ABS) is preferably used for the battery compartment body 7 and polyoxymethylene (POM) is preferably used for the latching element 10. These two materials can also be used in 2K injection molding methods using an adhesive agent for manufacturing the battery compartment body 7 and the latching element 10 in one working step. Alternatively, the latching element 10 is manufactured separately and force-fitted and/or clamped into the holding device 11.

In all cases, the latching element 10 sits fixedly in the battery compartment body 7 so that when latching the same with a hearing device housing and releasing this latch, it does not lose its hold in the holding device 11. A latching channel 13 of the latching element 10 is moved into a corresponding tongue-shaped connecting element of the hearing device housing in order to engage in the hearing device housing.

If the battery compartment body 7 and the latching element 10 are manufactured in two pieces, the latching element 10 can, after use or damage for instance, be removed from the holding device 11 and easily replaced by a new latching element 10 for exchange purposes.

Figure 3:
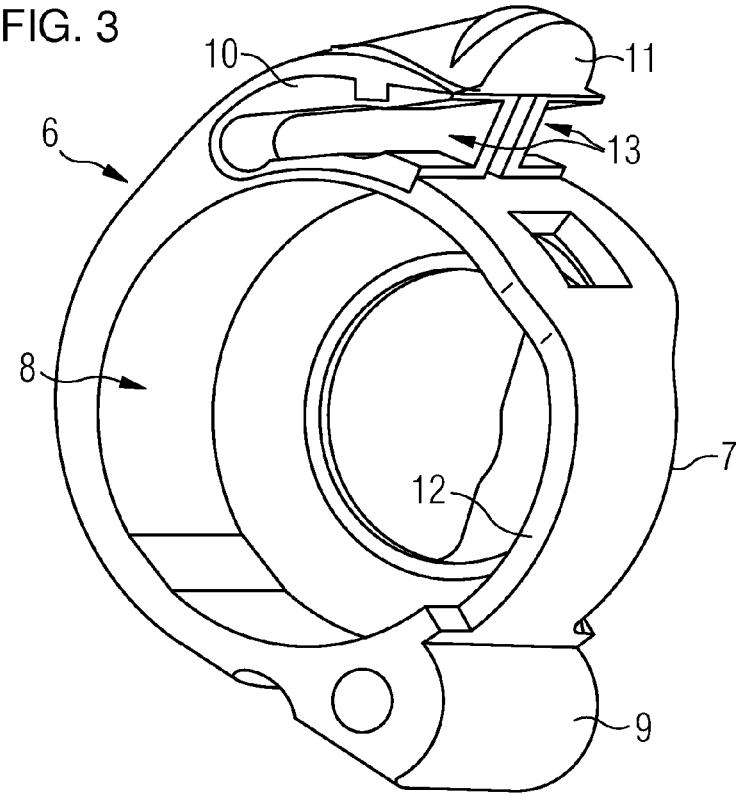
FIG. 3 is a perspective view of a battery compartment with two latching elements according to the invention.

FIG. 3 shows a perspective view of a battery compartment 6 according to the invention, including a battery compartment body 7, which creates a battery receiving space 8 for receiving a non-illustrated battery. The battery receiving space 8 is delimited by a wall 12 of the battery compartment body 7. The battery compartment 6 has a cylindrical projection, which forms a swivel joint 9, for swivelable fastening of the battery compartment 6 in a hearing device housing.

A tongue-shaped holding device 11 with a longitudinal opening, in which two latching elements 10 are disposed in parallel to one another, is positioned on the side of the wall 12 facing the swivel joint 9. The two latching elements 10 and the battery compartment body 7 are manufactured from different plastics. The battery compartment body 7 can therefore be transparent, while the latching element 10 is formed from a colored plastic with high durability compared with common latches. The latching elements 10 each include a respective latching channel 13, for engagement into a corresponding element of the hearing device housing.

The latching elements 10 can also be formed in such a way that they also include a battery holding spring.

The invention claimed is:

1. A battery compartment for a behind-the-ear hearing device, the battery compartment comprising:

a battery compartment body defining a battery receiving space for accommodating a battery;

a holding device disposed in said battery compartment body; and at least one latching element disposed in said holding device for locking to a hearing device housing;

said at least one latching element and said battery compartment body being formed from different materials and said material of said at least one latching element being a plastic suitable for multiple latches.

2. The battery compartment according to claim 1, wherein said at least one latching element is releasably fixedly held in an opening of said holding device by a clamping fit.

3. The battery compartment according to claim 1, wherein said battery compartment body has a wall, and said holding device is part of said wall.

4. The battery compartment according to claim 1, wherein said at least one latching element is one of two latching elements having mutually parallel latching channels.

5. The battery compartment according to claim 4, wherein at least one of said latching elements has a battery holding spring.

6. The battery compartment according to claim 1, wherein said at least one latching element has a color used as a right-left identifier.

7. A battery compartment for a behind-the-ear hearing device, the battery compartment comprising:

a battery compartment body defining a battery receiving space for accommodating a battery;

a holding device disposed in said battery compartment body; and at least one latching element disposed in said holding device for locking to a hearing device housing;

said at least one latching element and said battery compartment body being formed from different materials; and said battery compartment body and said at least one latching element being produced in one operation in a 2K injection molding method.

8. A battery compartment for a behind-the-ear hearing device, the battery compartment comprising:

a battery compartment body defining a battery receiving space for accommodating a battery;

a holding device disposed in said battery compartment body; and at least one latching element disposed in said holding device for locking to a hearing device housing;

said at least one latching element and said battery compartment body being formed from different materials and said material of said at least one latching element being polyoxymethylene (POM).

9. A behind-the-ear hearing device, comprising:

a microphone;

an earpiece; and a battery compartment including a battery compartment body defining a battery receiving space for accommodating a battery, a holding device disposed in said battery compartment body, and at least one latching element disposed in said holding device for locking to a hearing device housing;

said at least one latching element and said battery compartment body being formed from different materials and said material of said at least one latching element being polyoxymethylene (POM).

* * * * *